United States Patent [19]

Korthase

[11] 4,067,137

[45] Jan. 10, 1978

[54] COLLAPSIBLE DOLL HOUSE

[76] Inventor: Craig F. Korthase, 3606 Magnolia Blvd., Seattle, Wash. 98199

[21] Appl. No.: 691,502

[22] Filed: June 1, 1976

[51] Int. Cl.[2] ..... A63H 33/00

[52] U.S. Cl. ..... 46/12; 52/66; 52/641

[58] Field of Search ..... 46/12, 19, 21; 52/66, 52/70, 641, 109

[56] References Cited

U.S. PATENT DOCUMENTS

| | | | |
|---|---|---|---|
| 243,873 | 7/1881 | Dorn et al. | 46/12 X |
| 2,350,904 | 6/1944 | King | 52/641 X |
| 3,231,942 | 2/1966 | O'Brien | 46/12 X |
| 3,456,380 | 7/1969 | Cameron | 46/12 X |
| 3,557,500 | 1/1971 | Schmidt et al. | 52/109 X |

FOREIGN PATENT DOCUMENTS

| | | | |
|---|---|---|---|
| 2,220,641 | 10/1974 | France | 52/641 |
| 915,756 | 1/1963 | United Kingdom | 52/641 |

*Primary Examiner*—F. Barry Shay

[57] ABSTRACT

A doll house which collapses, without disassembly, to permit its convenient storage. The collapsible doll house includes two full length side members which mate along their respective upper edges, thereby defining the top ridge of the doll house, and then slope outwardly and downwardly therefrom, thereby defining the sides and roof of the doll house. The lower edges of the two side members are joined by a lower horizontal member to form the floor of the doll house. Additional horizontal members joining the two side members may be provided at one or more vertical locations between the upper and lower edges of the two side members. Each horizontal member, including one preferably located near the top ridge of the doll house, comprise at least two portions, which portions are connected, respectively, to the two side members and to each other in such a manner as to permit the lower edges of the two side members to be swung toward each other when the horizontal member portions are folded, thereby resulting in a collapsed doll house having a relatively small width compared to its other dimensions.

13 Claims, 9 Drawing Figures

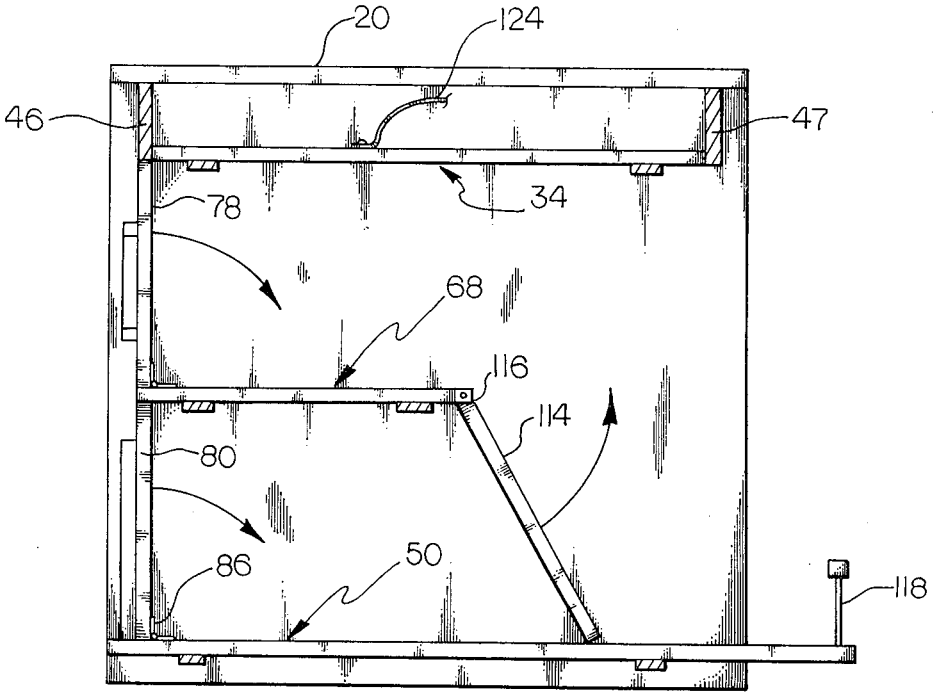
Fig. 9
Fig. 7
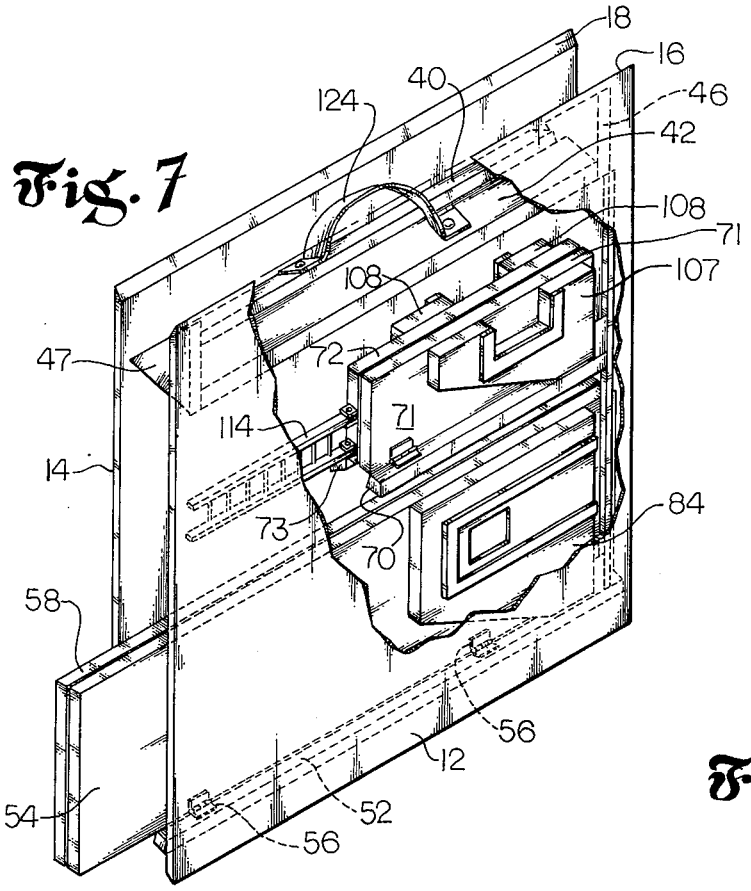
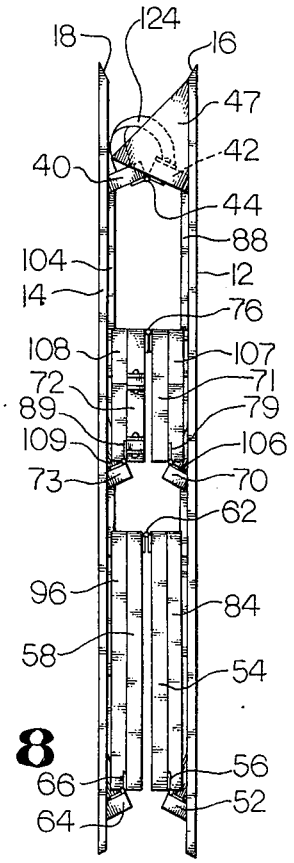
Fig. 8

COLLAPSIBLE DOLL HOUSE

BACKGROUND OF THE INVENTION

The present invention relates generally to the art of doll house design and construction, and more specifically is concerned with a specific type of doll house, which, by the nature of its construction, can be folded or collapsed so that it occupies a relatively small volume when collapsed compared to the volume it occupies when erect.

Traditionally, a structure which is designed for use with dolls or similar miniature models of humans, animals and accessories has been termed a "doll house", and has either been a unitary structure which is both used and stored in a fully erect position, or alternatively has been disassembled by use of securing means such as screws, pegs and the like.

The smaller size doll houses are typically unitary structures and as such, although somewhat inconvenient to store, do not require much space. However, such small size doll houses have the disadvantage of requiring extremely small dolls and accessories, which are often difficult to obtain, expensive, and difficult for children, especially small children, to play with. Furthermore, such small models and accessories are more easily lost. All of these factors combine to discourage use of small size doll houses.

On the other hand, however, as the doll house increases in size, in order to accommodate larger dolls and accessories and to permit easier and more enjoyable use by children, the doll house becomes not only more expensive, but requires a considerable amount of room for storage when it is not in use. The requirement of storage space is particularly disadvantageous in those situations where living space is at a premium, such as in apartments, trailers and condominiums. Unfortunately, it is in those rather confined living situations where the larger structures, which permit more fanciful and varied use and hence exercise the imaginations of young users, are frequently most needed.

Doll houses do presently exist which have at least a limited capacity to collapse, because they may be completely or partially disassembled. Such structures, while permitting efficient use of storage space, have the inherent disadvantage that one or more of the constituent parts of the doll house may be easily lost, thus decreasing the usefulness and attractiveness of the doll house. Eventually, when enough parts are lost, the doll house cannot be used at all. The assembly and disassembly of such a doll house, furthermore, often requires some degree of mechanical skill, as well as a considerable amount of time, and frequently requires the assistance of an adult. All of these disadvantages combine to decrease the long term enjoyable use of such a doll house.

Accordingly, it is a general object of the present invention to provide a doll house which overcomes one or more of the specific disadvantages of the prior art discussed above.

Another object of the present invention is to provide a doll house which is relatively simple in construction and which, when collapsed, is relatively narrow compared to its other dimensions, thereby facilitating convenient storage thereof when not in use.

It is another object of the present invention to provide such a doll house which may be collapsed without disassembly of its constituent parts.

It is another object of the present invention to provide such a doll house which has multiple floors and may be collapsed as a unit.

It is another object of the present invention to provide such a doll house which may be made in various sizes, utilizing similar principles of collapsible construction.

It is yet another object of the present invention to provide such a doll house which may be erected and collapsed easily, quickly and without adult supervision.

Other and further objects, features and advantages of the invention will become apparent as the description proceeds.

SUMMARY OF THE INVENTION

Accordingly, the present invention is a doll house having a particular structural arrangement which permits it to conveniently collapse into a relatively small volume for purposes of storage. The doll house includes first and second panel members, with each panel member having top and bottom edges, the panel members being so positioned relative to each other when the doll house is in an erect position that they 1) mate along their respective top edges to form the ridge of the doll house and further 2) extend downwardly and outwardly from the ridge such that the lower edges of the panel members are resultingly spaced a substantial distance apart. In this arrangement, the panel members form both the side walls and the roof of the doll house when it is in an erect position. Such a doll house further includes an upper horizontally-disposed bracing member which extends between and is secured to the respective panel members in the vicinity of the upper edges thereof, with the upper bracing member comprising first and second longitudinal portions and first means positioned substantially intermediate the panel members for movably connecting the first and second longitudinal portions of the upper bracing member. A lower horizontally-disposed bracing member is also provided which extends between and is secured to the respective panel members in the vicinity of the lower edges thereof. The lower bracing member comprises first and second longitudinal portions and second means positioned substantially intermediate the panel members for movably connecting the first and second longitudinal portions of the lower bracing member. Upon proper displacement and relative movement of the first and second longitudinal portions of both the upper and lower bracing members, the lower edges of the panel members tend to move toward each other and the upper edges thereof away from each other until the distance between said panel members is substantially the same at the upper edges as at the lower edges when the doll house is completely collapsed, with the distance being relatively small compared to the other dimensions of the panel members.

DESCRIPTION OF THE DRAWINGS

A more thorough understanding of the invention may be obtained by a study of the following detailed description taken in connection with the accompanying drawings in which:

FIG. 2 is a direct front view of the doll house of FIG. 1;

FIG. 7 is an oblique, partially cut-away, view of the doll house of FIG. 1 when it is fully collapsed;

FIG. 8 is a direct rear view of the doll house of FIG. 1 when it is fully collapsed as shown in FIG. 7;

FIG. 9 is a section view of the doll house of FIG. 1, taken along the lines 9—9 of FIG. 2, showing the direction of collapse of certain elements of the doll house.

DESCRIPTION OF THE PREFERRED EMBODIMENT

Figures 1, 3:
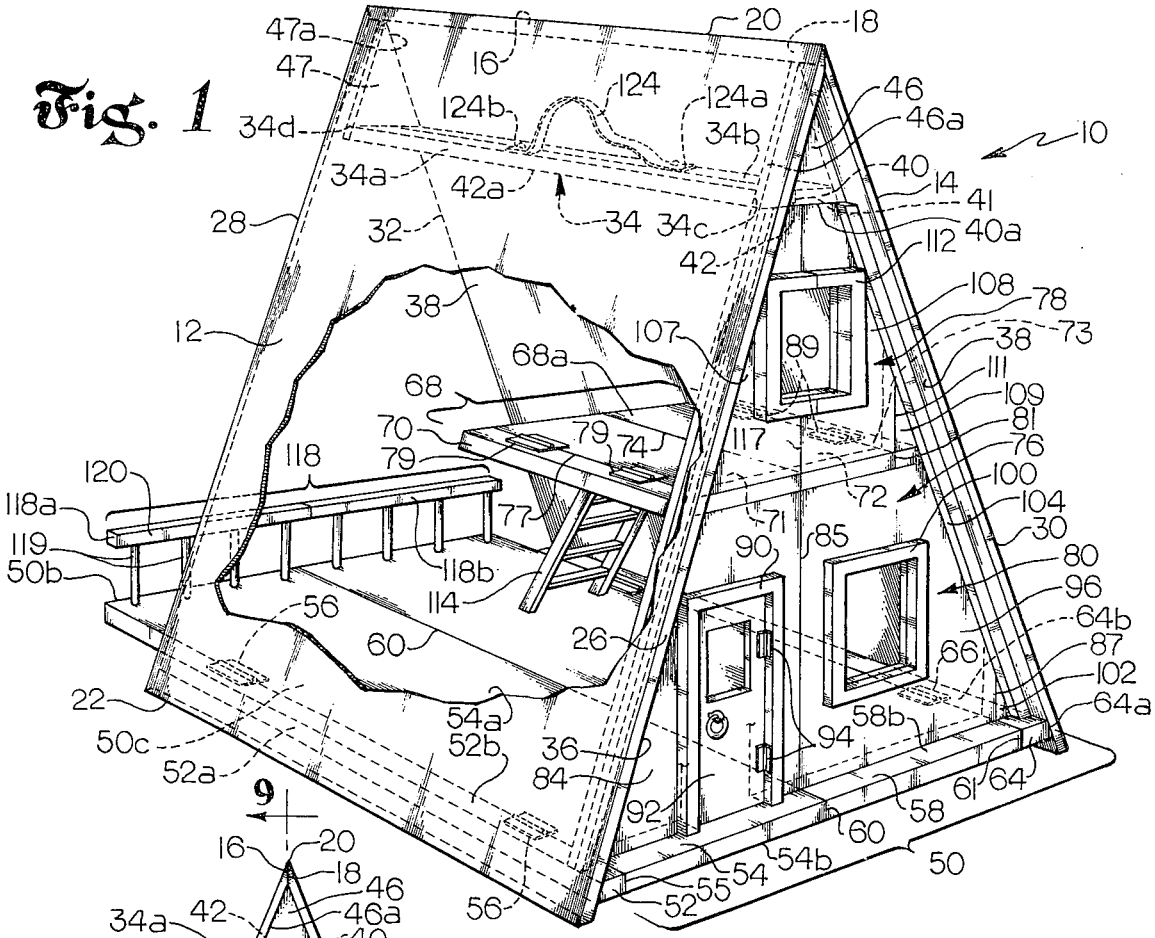
FIG. 1 is an oblique, partially cut-away, view of the doll house of the present invention in its erect position.
FIG. 3 is a direct rear view of the doll house of FIG. 1 looking into the interior thereof.

Referring now to FIGS. 1, 2 and 3, the collapsible doll house of the present invention is shown generally at 10 (FIG. 1) in its erect position. Identical side members 12 and 14 extend substantially the full longitudinal length of the doll house. Upper edge 16 of side member 12 is beveled so as to mate with beveled upper edge 18 of side member 14 to form a ridge 20 of the doll house. From ridge 20, side members 12 and 14 slope outwardly and downwardly until they terminate, respectively, in lower edge 22 of side member 12 and lower edge 24 of side member 14 which contact a supporting surface for the doll house.

Connecting upper edge 16 and lower edge 22 of side member 12 are a front edge 26 and a rear edge 28. Upper edge 18 and lower edge 24 of side member 14 likewise are connected by a front edge 30 and a rear edge 32. Front edges 26 and 30 define part of the outline of the front of doll house 10, while rear edges 28 and 32 define part of the outline of the rear of doll house 10.

Side members 12 and 14 are preferably identical in size and shape and are preferably rectangular panels, manufactured from a variety of materials such as solid, laminated, or particle board wood, metal, plastic, or any other sufficiently stiff material. Side members 12 and 14 may in addition have differing exterior treatments, including the use of shingles, or they may be painted in a variety of ways, all in accordance with the desires of the user.

Referring again to FIGS. 1, 2 and 3, an upper horizontal member 34 is positioned a relatively small distance below ridge 20, and extends between the front and rear edges of side members 12 and 14 for virtually the entire length of the doll house. Upper horizontal member 34 is an elongated rectangle in the embodiment shown in the drawings, with opposing longitudinal edges 34*a* and 34*b* being beveled to mate with, respectively, inner surface 36 of side member 12 and inner surface 38 of side member 14.

Upper horizontal member 34 is divided into two longitudinal portions 40 and 42 along a first dividing line 41 which is mid-way between longitudinal edges 34*a* and 34*b* and is coincident with the longitudinal axis of doll house 10 in a first longitudinally extending vertical plane. First and second longitudinal portions 40 and 42 are rotatably connected by a set of hinges 44, which are positioned at spaced locations along dividing line 41 on the under surface 40*a* and 42*a*, respectively, of longitudinal portions 40 and 42. Hinges 44 are arranged to permit longitudinal portions 40 and 42 to pivot about dividing line 41. Side members 12 and 14 move with first and second longitudinal portions 40 and 42, since they are non-movably secured thereto.

When doll house 10 is in its erect position, first and second longitudinal portions 40 and 42 are in the same horizontal plane, and abut each other along dividing line 41. By virtue of this physical arrangment, and because longitudinal edges 34*a* and 34*b* are secured, respectively, to inner surfaces 36 and 38 of side members 12 and 14, and because hinges 44 are positioned on the respective under surfaces 40*a* and 42*a* of longitudinal portions 40 and 42, upper horizontal member 34 as a whole provides substantial structural support and rigidity for the upper portion of the doll house.

Triangle members 46 and 47 are positioned vertically at the opposite ends 34*c* and 34*d* of upper horizontal member 34 and fill the space bounded by inner surface 36, inner surface 38 and upper horizontal member 34 at the front and rear, respectively of the doll house.

Triangle member 46 is secured along one side 46*a* thereof to inner surface 36, while triangle member 47 is likewise secured along one side 47*a* thereof to inner surface 36. Since triangle members 46 and 47 are each secured to only one side member, and since upper edges 16 and 18 of side members 12 and 14 are not secured together, upper edges 16 and 18 swing slightly away from each other during the collapse of the doll house, when first and second longitudinal portions 40 and 42 are rotated about dividing line 41 through hinges 44. Viewing doll house 10 from the front, as shown in FIG. 2, longitudinal portion 40 will rotate clockwise, while longitudinal portion 42 will rotate counterclockwise about dividing line 41 during collapse. The collapsing action of the longitudinal portions 40 and 42 of upper horizontal member 34, as well as side members 12 and 14 and triangle members 46 and 47 will be described in more detail in following paragraphs of this specification.

A lower horizontal member is shown generally at 50, and extends between inner surfaces 36 and 38, respectively, of side members 12 and 14 near lower edges 22 and 24 thereof for the length of the doll house. When the doll house is erect, lower horizontal member 50 serves as a structural support for side members 12 and 14 and maintains lower edges 22 and 24 thereof a spaced distance apart, such that side member 12, side member 14 and lower horizontal member 50 define, in outline, a triangle when the doll house is viewed from either the front or the rear. Such a structure is typically referred to as an A-frame, either when in miniature, as in a doll house, or in full size, as in a residence.

Lower horizontal member 50 preferably takes the shape of a rectangle and extends longitudinally from approximately a line connecting front edges 26 and 30 of side members 12 and 14 at least to, and in one embodiment slightly beyond, a line connecting rear edges 28 and 32 of side members 12 and 14. In the embodiment shown in the drawings, lower horizontal member 50 extends slightly beyond rear edges 28 and 32 so as to provide a porch or deck area at the rear of the doll house 10.

Lower horizontal member 50, besides serving as the lower structural support element for the erect doll house, also serves as its first floor. Thus when the doll house is erect, the combination of side members 12 and 14, upper horizontal member 34, and lower horizontal member 40 form a structure having two sides which slope from a ridge down to a termination point at the base or bottom floor thereof, the sides serving both as the sides and the roof of the doll house. This is the basic structure of the doll house which is capable of collapsing, as will be seen, as an integral unit.

Lower horizontal member 50 in detail comprises, in lateral sequence between side member 12 and side member 14, a first edge portion 52, a first folding longitudinal portion 54, a second folding longitudinal portion 58, and a second edge portion 64. First edge portion 52 is secured along one longitudinal edge 52*a* to inner surface 36 and extends laterally from there to dividing line 55 in a second longitudinally extending vertical plane, where it abuts first folding portion 54. First edge portion 52 is relatively narrow compared to the total width of lower horizontal member 50, and is somewhat narrower than longitudinal portions 40 and 42 of upper horizontal member 34. In the embodiment shown in the drawings, first edge portion 52 extends approximately from a line connecting front edges 26 and 30 to a termination point in the vicinity of, or just prior to a line connecting rear edges 28 and 32.

First folding portion 54 extends laterally from dividing line 55, where it abuts first edge portion 52 along its longitudinal dimension, to dividing line 60, which is located approximately mid-way between side members 12 and 14 and is in said longitudinally extending first vertical plane. At dividing line 60, it abuts second folding portion 58 along its longitudinal dimension. In the embodiment shown in the drawings, first folding portion 54 extends longitudinally approximately from a line connecting front edges 26 and 30 to a termination point some relatively small distance beyond a line connecting rear edges 28 and 32.

When doll house 10 is erect, first edge portion 52 mates withfirst folding portion 54 and is furthermore rotatably connected thereto along dividing line 55 by hinges 56, which are located at spaced positions therealong on upper surfaces 52*b* and 54*a* (FIG. 1), respectively, of first edge portion edge 52 and first folding portion 54. This arrangement permits first folding portion 54 to rotate counter-clockwise (front view) with respect to first edge portion 52.

The next successive portion in lower horizontal member 50 is second folding portion 58, which, in the embodiment shown in the drawings, is identical in size and configuration to first folding portion 54. It extends laterally from dividing line 60, where it abuts first folding portion 54 along its longitudinal dimension in said first longitudinally extending vertical plane to dividing line 61, where it mates with second edge portion 64 in a third longitudinally extending vertical plane. Second folding portion 58 is longitudinally co-extensive with first folding portion 54. First and second folding portions 54 and 58 form the major lateral part of lower horizontal member 50 and hence, the major part of the first floor or story surface area of the doll house, as well as substantially all of the extended deck area at the rear of the doll house.

First and second folding portions 54 and 58 are rotatably connected together along dividing line 60 by hinges 62, which are positioned at spaced locations along dividing line 60 on the lower surfaces 54*b* of first folding portion 54 and 58*a* of second folding portion 58. Such an arrangement permits first and second folding portions 54 and 58 to be rotated relative to each other in substantially the same manner as first and second longitudinal portions 40 and 42 of upper horizontal member 34, so to further permit rotation of each folding portion towards their associated side members.

The next and last portion in lower horizontal member 50 is second edge portion 64, which is substantially identical to first edge portion 52 in size and configuration, except that the configuration of the longitudinal edges of edge portion 64 is a mirror image of those of first edge portion 52. Edge portion 64 extends laterally from dividing line 61, where it abuts second folding portion 58 along its longitudinal dimension in the third longitudinally extending vertical plane, to inner surface 38 of side member 14, to which it is permanently affixed along longitudinal edge 64*a*. Second edge portion 64, like first edge portion 52, extends longitudinally from a line connecting front edges 26 and 30 to a termination point just prior to a line connecting rear edges 28 and 32.

Second edge portion 64 is rotatably connected to second folding portion 58 along dividing line 61 by hinges 66 which are positioned at spaced locations along dividing line 61 on upper surfaces 58*b* and 64*b*, respectively, of second folding portion 58 and second edge portion 64, thereby permitting clockwise rotation of second folding portion 58 with respect to second edge portion 64, as seen in front view (FIG. 2).

Intermediate horizontal member 68 is positioned in the embodiment shown in the drawings substantially vertically intermediate of lower horizontal member 50 and upper horizontal member 34. Intermediate horizontal member 68 extends between inner surfaces 36 and 38, as does lower horizontal member 50 and upper horizontal member 34, and comprises laterally in succession between inner surfaces 36 and 38 a first edge portion 70, a first folding portion 71, a second folding portion 72 and a second edge portion 73.

The structural arrangement of portions 70–73 of intermediate horizontal member 68 relative to each other and to side members 12 and 14 is substantially identical to the arrangement of lower horizontal member 50 and hence, no similarly detailed explanation of portions 70–73 are provided.

First and second edge portions 70 and 73 are approximately the same width as first and second edge portions 52 and 64 of lower horizontal member 50, and hence slightly less than the width of horizontal portions 40, 42 of upper horizontal member 34. First and second folding portions 71 and 72 mate together along dividing line 74 through hinges 76 which is in the first longitudinally extending vertical plane along with dividing line 41 in upper horizontal member 34 and dividing line 60 in lower horizontal member 50. First edge portion 70 and first folding portion 71 mate together along dividing line 77 through hinges 79. Second folding portion 72 and second edge portion 73 mate together along dividing line 81 through hinges 89. This arrangement makes possible the convenient collapse of the doll house as a unit, without the need for disassembly.

In the embodiment shown in the drawings, intermediate horizontal member 68 extends longitudinally from approximately a line connecting front edges 26 and 30 of the doll house to a termination point approximately longitudinally mid-way between the front and rear of the doll house, thus defining a second story loft for the doll house.

It should be understood, however, that additional horizontal members, which would form additional floors or stories of the doll house, may be included in the embodiment shown in the drawings, at different vertical heights and extending for differing longitudinal lengths, without departing from the spirit of the present invention.

Side members 12 and 14, in combination with the horizontal members 34, 50 and 68 form the basic structure of the doll house embodiment shown in the drawings, and further are interconnected in such a manner that no one portion is capable of any movement without causing movement in a prescribed manner of another portion thereof. Side members 12 and 14 define the sides and roof of the doll house, while upper horizontal member 34, lower horizontal member 50, and intermediate horizontal member 68 form the floors or stories of, as well as providing the required structural support for, the doll house.

When the several horizontal members are displaced in a particular direction, as clarified hereinafter, the lower edges of the side members 12 and 14 are accordingly displaced toward each other until they are separated by only a relatively small distance, and the doll house is ready to be stored.

In the embodiment of the present invention shown in the drawings, the doll house 10 has vertical front wall shown generally at 76 but no rear wall, so that doll house 10 is essentially open at the rear to permit conventional doll house use. Front wall 76 is divided into an upper section 78 and a lower section 80.

Upper section 78 extends generally between intermediate horizontal member 68 and upper horizontal member 34 in the vertical direction, and between inner surfaces 36 and 38 in the lateral direction, and thus forms the second story front wall for the doll house.

Lower section 80 extends generally between lower horizontal member 50 and intermediate horizontal member 68 in the vertical, and between inner surfaces 36 and 38 in the horizontal, and thus forms the first story front wall of the doll house. The combined effect of upper section 78 and lower section 80 is a complete front wall 76 for the doll house.

In detail, lower section 80 comprises four successive vertical portions between inner surface 36 of side member 12 and inner surface 38 of side member 14. A first edge portion 82 stands perpendicular to horizontally disposed first edge portion 52 of lower horizontal member 50, and extends from inner surface 36 of side wall 12 to dividing line 83, where it abuts first collapsing portion 84, dividing line 83 being coincident with dividing line 55 in said second longitudinally extending vertical plane. First edge portion 82 is configured so that it mates with the sloping inner surface 36, and further is secured thereto.

First collapsing portion 84 extends from dividing line 83 to dividing line 85, where it mates with a second collapsing portion 96, dividing line 85 being coincident with dividing lines 41 and 60 in the first longitudinally extending vertical plane which defines the longitudinal axis of the doll house. First collapsing portion 84 is rotatably connected by means of hinges 86 to the upper surface **54*a* of first folding portion 54 of lower horizontal member 50**.

This permits first collapsing member 84 to be swung inwardly of the doll house 10 flat against upper surface **54*a* of first folding portion 54. No connection per se exists between first collapsing portion 84, and first edge portion 82 or second collapsing portion 96 or inner surface 36 or intermediate horizontal member 68. A relatively thin elongated stop strip 88 is positioned on inner surface 36 substantially adjacent front edge 26, so that when first collapsing portion 84 comes into contact with stop strip 88, collapsing portion 84** is substantially vertical and is held in that position by frictional contact with immediately surrounding portions of the doll house.

A door opening of conventional shape, scaled to the size of the doll house, is provided in first collapsing portion 84, the opening for the door being bounded along its sides and top by a door frame 90. A door 92 is positioned in the opening and is swingably secured to one side of door frame 90 by means of hinges 94.

The next successive lateral portion in lower section 80 is second collapsing portion 96, which extends from dividing line 85 to dividing line 87, where it mates with a second edge portion 102, dividing line 87 being in said third longitudinally extending vertical plane with dividing line 61. Second collapsing portion 96 is rotatably connected to second folding portion 58 by hinges 98 in a similar fashion as first collapsing portion 84 is connected to first folding portion 54 by hinges 86. Such an arrangement permits second collapsing portion 96 to rotate inwardly of the doll house and to lie flat against second folding portion 58. A stop strip 104, similar in configuration to stop strip 88, is secured to inner surface 38 substantially adjacent front edge 30, such that when second collapsing portion 96 contacts stop strip 104 it is substantially vertical and in the same plane with first and second edge portions 82 and 102, and first collapsing portion 84. Second collapsing portion 96 is held in a vertical position by frictional contact with first collapsing portion 84, intermediate horizontal member 68, and inner surface 38.

A scaled-size opening in the shape of a square is provided in second collapsing portion 96 to serve as a window, the opening being bounded by window frame 100.

Extending from dividing line 87 to inner surface 38 is second edge portion 102, which in front outline (FIG. 2) is the mirror image of first edge portion 82, and is permanently secured in a vertical position to inner surface 38.

When the doll house is in its erect position, first and second edge portions 82 and 102 and first and second collapsing portions 84 and 96 are in the same laterally extending vertical plane and serve as the front wall of the first floor or story of the doll house. As the doll house is collapsed as will be seen hereinafter, the two edge portions 82 and 102 remain in position, while the two collapsing portions 84 and 96 collapse inwardly of the doll house against lower horizontal member 50.

Upper section 78 of front wall 76 is arranged substantially similar to that of lower section 80. Upper section 78 comprises four successive portions, a first edge portion 106, a first collapsing portion 107, a second collapsing portion 108, and a second edge portion 109. These portions are all in the same vertical plane with each other and with lower section 80, and define the vertical front wall of the upper story of the doll house when the doll house is erect.

First edge portion 106 and first collapsing portion 107 mate along a dividing line 105 which is in the same vertical plane with dividing line 77, while first collapsing portion 107 and second collapsing portion 108 mate along a dividing line 117 which is in said first longitudinally extending vertical plane with dividing lines 41, 60, 85 and 74, the longitudinal axis of the doll house. Second collapsing portion 108 mates with second edge portion 109 along dividing line 111, which is in the same longitudinal extending vertical plane as dividing line 81.

First and second edge portions 106 and 109, respectively, are secured to inner surfaces 36 and 38 while first and second collapsing portions 107 and 108 are rotatably connected through hinges to intermediate horizontal member 68, facilitating rotation of first and second collapsing portions 107 and 108 inwardly of the doll house against intermediate horizontal member 68. Stop strips 88 and 104, respectively, extend a sufficient length along inner surfaces 36 and 38 to act as stops for first and second collapsing portions 107 and 108 in similar fashion as for first and second collapsing portions 84 and 96 of lower section 80. An opening is provided in first and second collapsing portions 107 and 108 symmetrical about the vertical axis of the doll house (dividing line 117) which opening functions as a window for the second story of the doll house, with the opening being framed by a window frame 112.

The only fixed structural contact between the first and second collapsing portions 84 and 96 of lower section 80 and first and second collapsing portions 107 and 108 of upper section 78 and the remainder of the doll house are through hinges connecting each respective collapsing portion to their associated horizontal members. This arrangement facilitates ease of collapse of the structure while maintaining at least one point of fixed structural contact between the various collapsing portions of front wall 76 and the remainder of the doll house.

In addition to its basic structural features discussed at length above, the doll house shown in the drawings includes a scaled-size ladder 114 which extends from rear edge 68*a* of intermediate horizontal member 68 down to horizontal member 50. Ladder 114 is connected at its upper end 116 to the rear edge 68*a* of intermediate horizontal member 68 by means of hinges 113 or similar means, permitting ladder 114 to be rotated about intermediate horizontal member 68 as shown in FIG. 9 to facilitate collapse of the doll house.

A balcony railing 118 is also provided adjacent the rear edge of lower horizontal member 50 for the portion thereof which extends beyond rear edges 28 and 32 of side members 12 and 14. Railing 118 is divided into two sections 118*a* and 118*b*, which are positioned, respectively, perpendicular to first and second folding portions 54 and 58 of lower horizontal member 50 and which mate together when the doll house is in its erect position.

Railing 118 consists of a series of vertical posts 119 connected across the respective upper ends thereof by a horizontal member 120. The lower ends of the posts 119 are adapted to be received into a plurality of openings in lower horizontal member 50 which are configured to permit ease of insertion and removal of railing 118 from the remainder of the doll house.

Another element provided with the doll house 10 is a carrying strap 124, which is an elongated length of flexible material, such as leather or nylon, which is attached at opposite ends 124*a* and 124*b* thereof, respectively, to first longitudinal portion 40 and second longitudinal portion 42 of upper horizontal member 34. Carrying strap 124 permits the doll house to be conveniently carried in its collapsed position.

Figure 4:
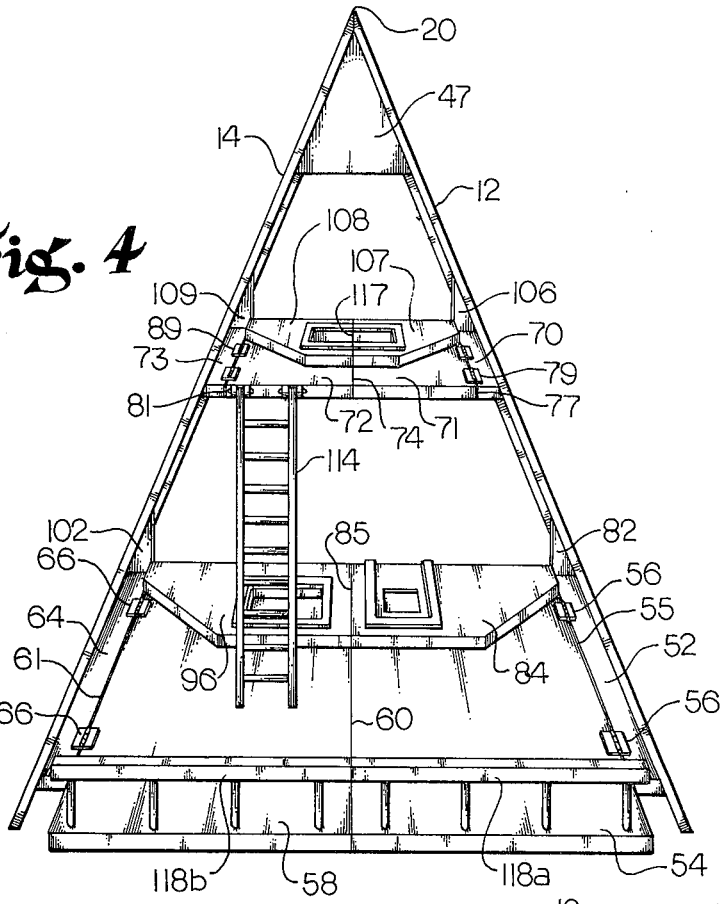
FIG. 4 is an oblique rear view of the doll house of FIG. 1 looking into the interior thereof when the front wall is in a collapsed position.

FIGS. 4 through 9 show the doll house of the present invention in various stages of collapse, demonstrating how its novel construction facilitates collapse of the structure into a conveniently storable package. FIGS. 4 and 9 show the doll house in its first stage of collapse. First and second collapsing portions 107 and 108 of upper section 78, and first and second collapsing sections 84 and 96 of lower section 80 are rotated inwardly of the doll house about their hinged connections with lower horizontal member 50 and intermediate horizontal member 68, respectively, and are laid flat thereagainst.

First and second edge portions 82 and 102 of lower section 80, and first and second edge portions 106 and 109 of upper section 78 remain vertical since they are permanently secured to inner surfaces 36 and 38 of side members 12 and 14. The appearance of the doll house 10 following this first step in the collapsing process, namely the rotation of the collapsing portions both of the upper and lower sections of front wall 76, is shown in FIG. 4.

Figure 6:
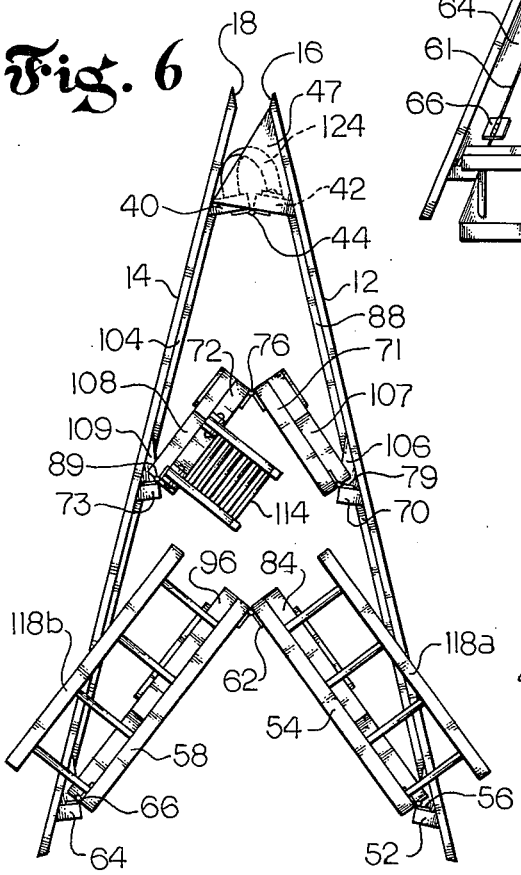
FIG. 6 is a direct rear view of the doll house of FIG. 1 when it is partially collapsed as shown in FIG. 5.
Figure 5:
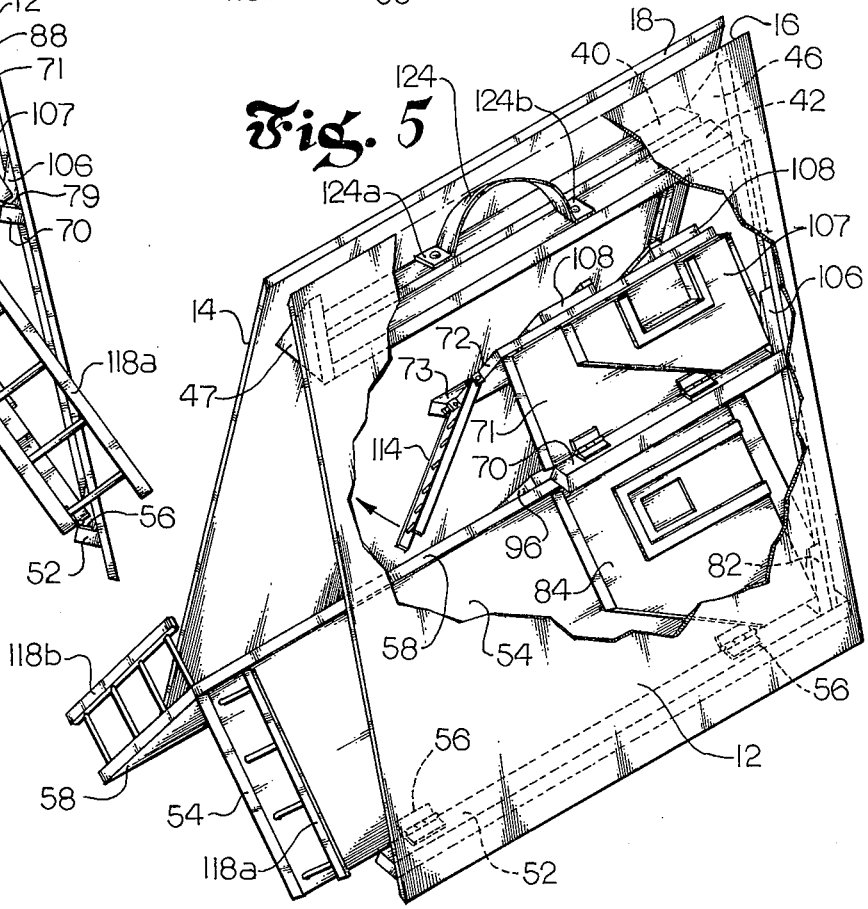
FIG. 5 is an oblique, partially cut-away, view of the doll house of FIG. 1 when it is partially collapsed.

FIGS. 5 and 6 show the doll house 10 in a second stage of collapse. In order to initiate this stage, an upwardly directed pressure is applied from beneath horizontal members 50 and/or 68, along dividing lines 60 and 74, respectively, which are both in said first longitudinally extending vertical plane defining the longitudinal axis of the doll house. Typically, once displacement of either or both of the folding portions of lower horizontal member 50 or intermediate horizontal member 68 is initiated, further collapse of the doll house is easy and convenient.

As doll house 10 begins to collapse, several actions occur simultaneously. Lower edges 22 and 24 of side walls 12 and 14 begin to move toward each other, while upper edges 16 and 18 move away from each other, leaving an elongated opening along the ridge 20 of the doll house. As the doll house begins to collapse, first and second longitudinal portions 40 and 42 of upper horizontal member 34 rotate about dividing line 41 through hinges 44. Simultaneously, first and second folding portions of intermediate horizontal member 68 rotate about dividing line 74 through hinges 76 and relative to first and second edge portions 70 and 73 thereof through hinges 79 and 89, with edge portions 70 and 73 remaining fixed to inner surfaces 36 and 38 of side walls 12 and 14. Due to the structural arrangement of intermediate horizontal member 68, folding portions 71 and 72 form an increasingly narrow inverted V as the doll house is collapsed. At the same time, ladder 114 is rotated upwardly out of the way of the folding action of lower horizontal member 50.

Lower horizontal member 50 and intermediate horizontal member 68 collapse in a similar manner. The collapse of lower horizontal member 50 from the erect position begins with an upwardly directed pressure beneath lower horizontal member 50 along dividing line 60, which is coincident with the longitudinal axis of the doll house and is in said first longitudinally extended vertical plane with dividing lines 41 and 74 of the other horizontal members.

First and second edge portions 52 and 64 of lower horizontal member 50 remain permanently secured to said members 12 and 14. When the doll house begins to collapse, lower edges 22 and 24 of side members 12 and 14 move toward each other, and first and second folding portions 54 and 58 rotate upwardly, respectively, about dividing line 55 between first edge portion 52 and first folding portion 54, through hinges 56, and about dividing line 61 between second edge portion 64 and second folding portion 58 through hinges 66. As the doll house collapses, first and second folding portions 54 and 58 form an inverted V with hinges 62 being at the center of the V.

The balcony railing 118 may be removed as a unit prior to collapse of the doll house, or may be removed at any time during or after the collapse of the doll house, as portion 118*a* of railing 118 will split apart from portion 118*b* thereof as the doll house collapses.

As the doll house collapses further beyond that shown in FIGS. 5 and 6, lower edges 22 and 24 of side members 12 and 14 move further towards each other, resulting in upper edges 16 and 18 moving correspondingly further away from each other. This essentially rotational movement of side members 12 and 14, through the hinges positioned along dividing lines 41, 60 and 74, will continue until first and second folding portions 54 and 58 of lower horizontal member 50 become parallel and almost abut each other, as do first and second folding portions 71 and 72 of intermediate horizontal member 68. At this point, because of the specific relationship in size and connection between the respective folding portions and edge portions of both lower and intermediate horizontal members 50 and 68, and the longitudinal portions of upper horizontal member 34, the distance separating lower edges 22 and 24 of side members 12 and 14 is approximately equal to the distance separating the upper edges 16 and 18 thereof.

FIGS. 7 and 8 show the doll house of the present invention in its fully collapsed state, with lower edges 22 and 24 being separated by approximately the same distance as upper edges 16 and 18. Folding portions 54 and 58 of lower horizontal member 50 parallel and nearly abut each other as do first and second folding portions 71 and 72 of intermediate horizontal member 68.

In the fully collapsed state, the width of the doll house between side members 12 and 14 is small, on the order of three to four inches, when compared with the other dimensions thereof. The doll house, when collapsed, may be conveniently stored. Because of its novel construction, there is little chance that any of its parts will be lost. Furthermore, the doll house is easily collapsed and erected and may be so used by young children without adult supervision.

Although the drawings disclose a preferred embodiment, it should be understood that modifications may be made to the invention without departing from the spirit thereof. For instance, although the preferred embodiment is made of wood, it should be understood that various materials may be conveniently utilized. Additionally, various rotatably connecting means may be used in place of hinges while additional floors or modifications of existing floors may be made as well. The size, configuration, and arrangement of openings in the doll house which serve as doors and windows in the embodiment shown and described may be easily modified by one skilled in the art. Furthermore, other structural modifications, such as connecting the sections of the front wall to a portion of the doll house other than the various horizontal members may be made by one skilled in the art, without departing from the spirit of the invention, as defined by the claims which follow.

What is claimed is:

1. A collapsible doll house, comprising:

a. first and second panel members, each having top and bottom edges, said panel members being positioned relative to each other when the doll house is erect so as to (1) mate along their respective top edges to form a ridge for the doll house, and further (2) extend downwardly and outwardly from said ridge such that said lower edges are spaced a substantial distance apart, said panel members thereby forming both the side walls and the roof of the doll house when it is erect;

b. an upper bracing member extending between and secured to said panel members in the vicinity of said upper edges thereof in position to be horizontally disposed between said panel members when the doll house is erect, said upper bracing member comprising first and second portions extending longitudinally of said panel members and first means positioned substantially intermediate said panel members for interconnecting said first and second longitudinal portions of said upper bracing member for relative movement about a first axis;

c. a lower bracing member extending between and secured to said panel members in the vicinity of said lower edges thereof in position to be horizontally disposed between said panel members when the doll house is erect, said bracing member comprising first and second portions extending longitudinally of said panel members and second means positioned substantially intermediate said panel members for interconnecting said first and second longitudinal portions of said lower bracing member, for relative movement about a second axis parallel to said first axis, so that, when the doll house is erect, upon proper movement of said first and second longitudinal portions of both said upper and lower bracing members about said axes, said lower edges of said panel members move toward each other and said upper edges of said panel members move away from each other until the distance between said panel members is substantially the same at the upper edges as at the lower edges thereof when the doll house is completely collapsed, said distance being relatively small compared to the other dimensions of said panel members.

2. An article of claim 1 wherein said panel members are substantially identical in size and configuration.

3. The article of claim 1 wherein said first and second panel members each have front and rear edges connecting said top and bottom edges and wherein the article includes a front wall positioned in the vicinity of said front edges of said panel members, said front wall being configured to fit within at least a portion of the area bounded by said first and second panel members and said upper and lower bracing members, said front wall comprising a plurality of vertical portions, each vertical portion being coincident laterally between said first and second panel members with a corresponding longitudinal portion of said lower bracing member.

4. An article of claim 3, wherein said article includes means movably connecting a sufficient number of vertical portions of said front wall to said doll house so as to permit movement of said sufficient vertical portions between a first, substantially vertical position, and a second position which is so located relative to the doll house as to facilitate collapse thereof.

5. An article of claim 4, wherein said second position is adjacent said lower bracing member.

6. An article of claim 1, wherein said first longitudinal portion of said lower bracing member is divided into a first edge portion which is secured to said first panel member, and a first folding portion which abuts said first edge portion, and wherein said second longitudinal portion of said lower bracing member is divided into a second edge portion which is secured to said second panel member, and a second folding portion which abuts said second edge portion, and wherein said lower bracing member includes means rotatably connecting said first edge portion and said first folding portion, and means rotatably connecting said second edge portion and said second folding portion, along first and second dividing lines, respectively so as to permit movement of said first folding portion about said first dividing line toward the inner surface of said first panel member, and movement of said second folding portion about said second dividing line toward the inner surface of said second panel member.

7. An article of claim 6 wherein said first and second edge portions have a width less than that of said first and second longitudinal portions of said upper bracing member.

8. An article of claim 5 wherein said front wall includes: a first edge portion secured to said first panel member and co-extensive laterally with said first edge portion of said lower bracing member; a first collapsing portion co-extensive laterally with said first folding portion of said lower bracing member; a second collapsing portion co-extensive laterally with said second folding portion of said lower bracing member; and a second edge portion secured to said second panel member and co-extensive laterally with said second edge portion of said lower bracing member.

9. An article of claim 8, wherein said first and second folding portions of said lower bracing member mate together in a vertical plane containing the longitudinal axis of the doll house when the doll house is erect, and wherein said first and second longitudinal portions of said upper bracing member mate together in said vertical plane containing the longitudinal axis of the doll house when the doll house is erect.

10. An article of claim 9 including an intermediate bracing member extending between and secured to said panel members substantially intermediate said upper and lower bracing members and in position to be horizontally disposed between said panel members when the doll house is erect, said intermediate bracing member comprising in succession; a first edge portion, a first longitudinal portion, a second longitudinal portion and a second edge portion, said first and second edge portions of said intermediate bracing member being connected, respectively, to said first and second panel members, said first and second edge portions of said intermediate bracing member being movably connected, respectively, to said first and second longitudinal portions of said intermediate bracing member which in turn mate together in the vertical plane containing the longitudinal axis of the doll house when the doll house is erect, the article further including means movably connecting said first and second longitudinal portions of said intermediate bracing member, thereby permitting relative movement of said first and second longitudinal portions of said intermediate bracing member and facilitating collapse of the doll house.

11. An article of claim 10 wherein said front wall comprises upper and lower parts, said lower part extending between said lower bracing member and said intermediate bracing member, and said upper part extending between said intermediate bracing member and said upper bracing member, said upper and lower parts each comprising a plurality of vertical portions, each of the vertical portions of said upper part being laterally co-extensive with a corresponding portion of said intermediate bracing member.

12. An article of claim 11 wherein said movably connecting means are hinge means.

13. An article of claim 11 including stop means positioned near said front edge of said first and second panel members in a manner such that when said front wall contacts said stop means when the doll house is erect, said front wall is in a substantially vertical position.

* * * * *